United States Patent [19]

Schmitt et al.

[11] Patent Number: 4,801,288

[45] Date of Patent: Jan. 31, 1989

[54] RAILROAD HAND BRAKE CHAIN LINK STRIPPER

[75] Inventors: Eugene W. Schmitt, Lockport; Richard L. Cotterell, Villa Park, both of Ill.

[73] Assignee: Sloan Valve Company, Franklin Plaza, Ill.

[21] Appl. No.: 97,128

[22] Filed: Sep. 16, 1987

[51] Int. Cl.[4] ..... F16G 13/00

[52] U.S. Cl. ..... 474/140; 474/144

[58] Field of Search ..... 474/140, 144, 151

[56] References Cited

U.S. PATENT DOCUMENTS

| | | | |
|---|---|---|---|
| 414,774 | 11/1889 | Merrel | 474/140 |
| 2,292,688 | 8/1942 | Haines et al. | 474/140 X |
| 2,526,173 | 10/1950 | Thomassin | 474/140 |

FOREIGN PATENT DOCUMENTS

| | | | |
|---|---|---|---|
| 553087 | 5/1943 | United Kingdom | 474/144 |

*Primary Examiner*—Jerome W. Massie
*Assistant Examiner*—Matthew Smith
*Attorney, Agent, or Firm*—Kinzer, Plyer, Dorn, McEachran & Jambor

[57] ABSTRACT

A railroad car hand brake has a housing with a chain opening in said housing. There is a shaft mounted in the housing which mounts a chain drum which is rotated by a drive gear. The drum is formed and adapted to engage a link chain whereby turning of the drum moves the chain inwardly through the housing opening, around the drum and then outwardly through the housing opening. A chain stripper is attached to the housing and has a portion thereof positioned between the incoming and outgoing chain, in alignment with and extending toward the drum to prevent the chain from wrapping around the drum.

1 Claim, 2 Drawing Sheets

Fig.1.
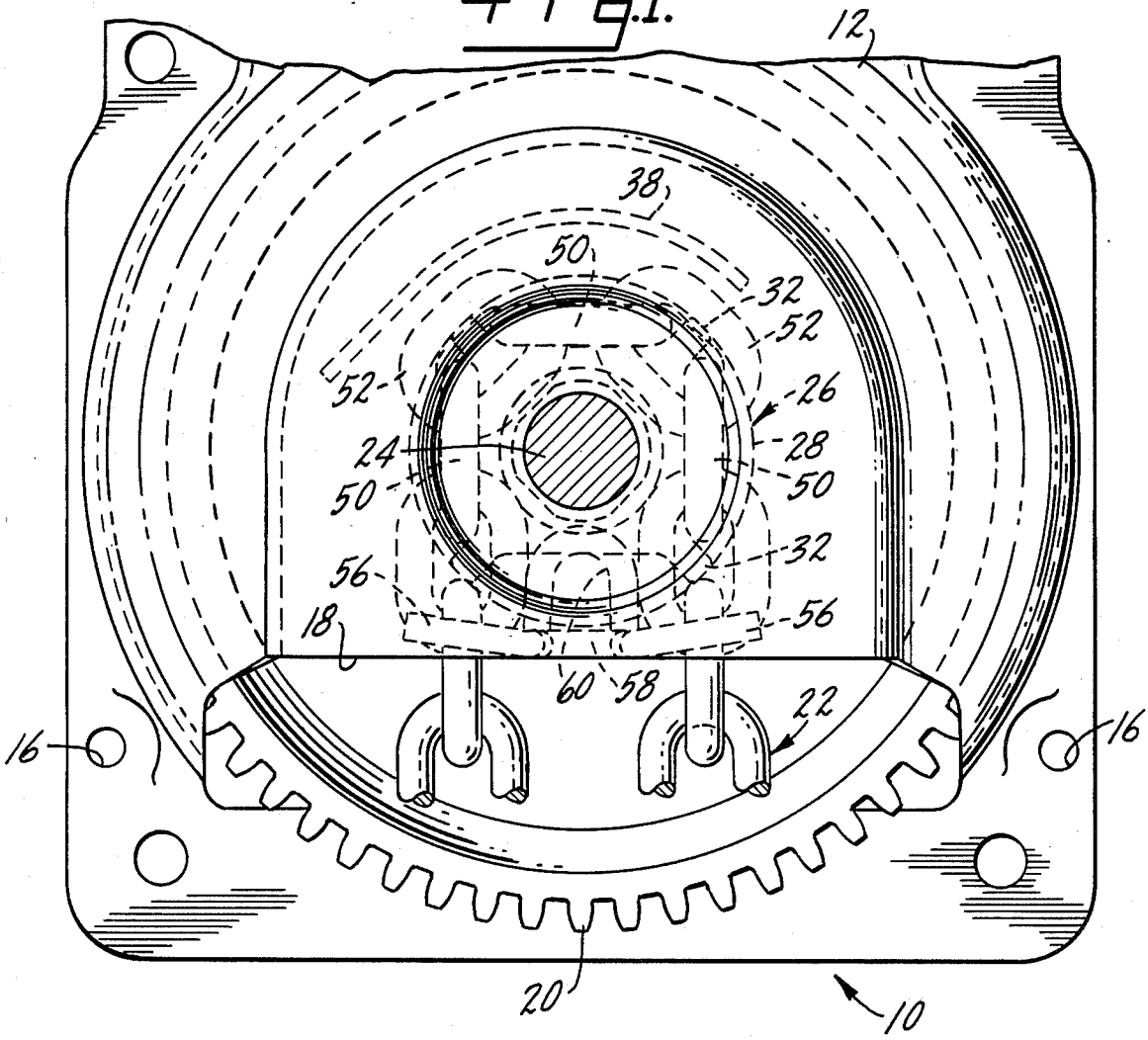
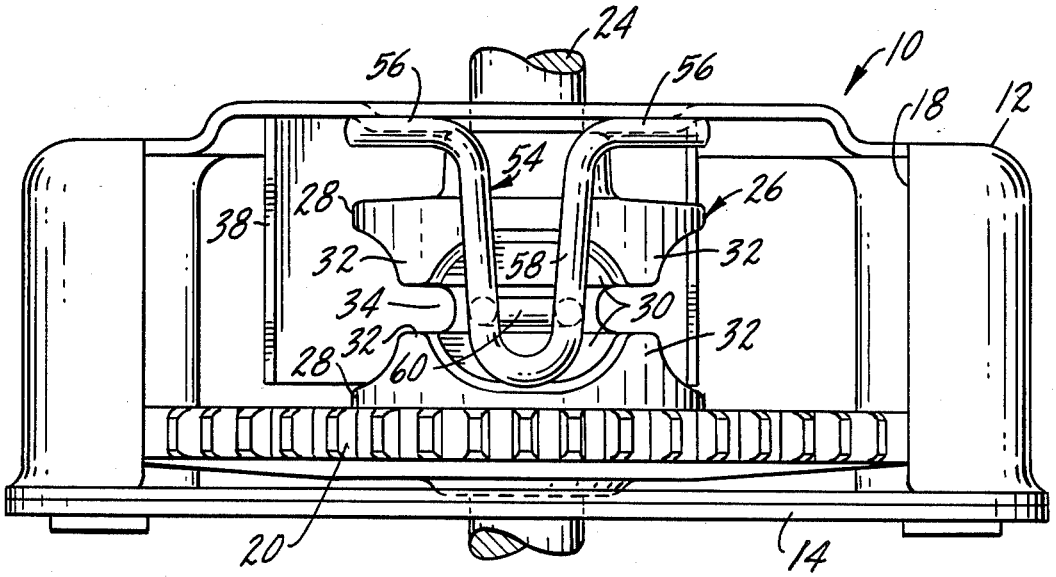
Fig.2.

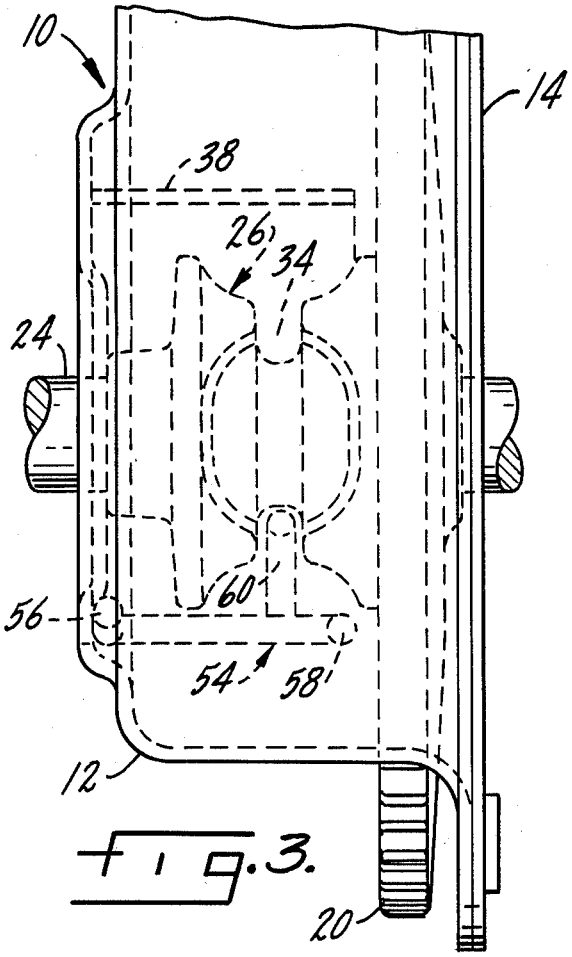
Fig. 3.
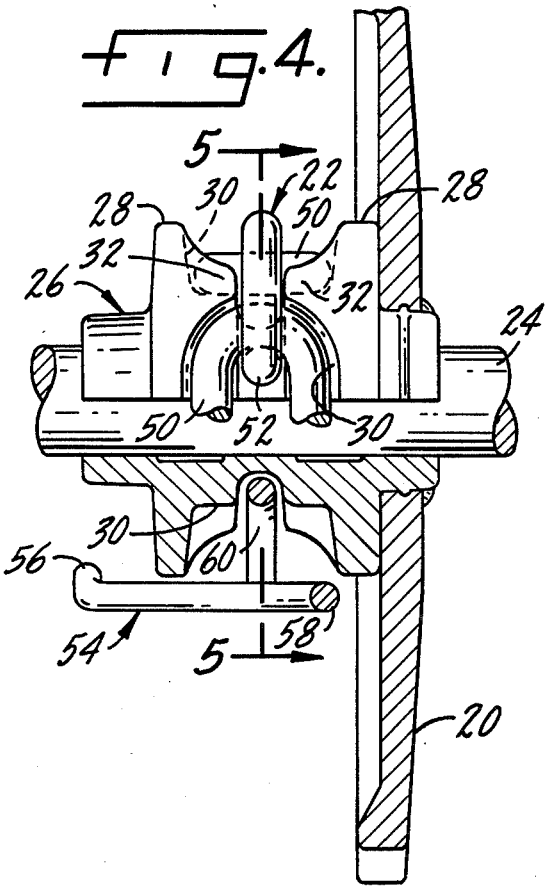
Fig. 4.
Fig. 5.
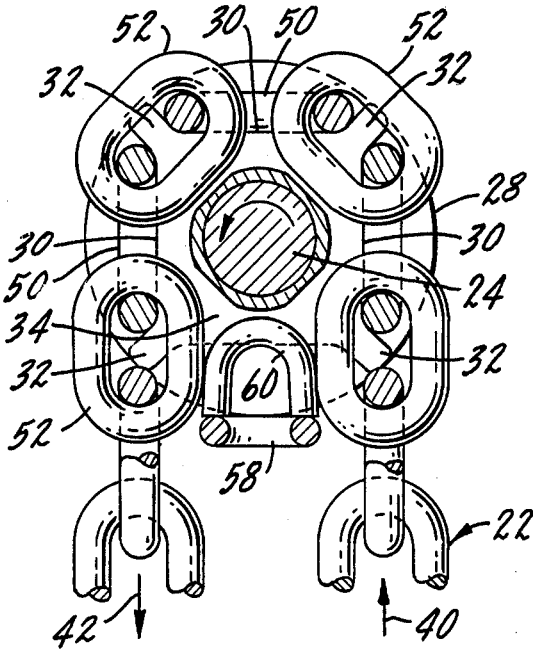

RAILROAD HAND BRAKE CHAIN LINK STRIPPER

SUMMARY OF THE INVENTION

The present invention relates to railroad car hand brakes and particularly to a chain stripper which prevents the hand brake chain from wrapping around the chain drum as the hand brake is turned.

A primary purpose of the invention is a simply constructed and reliably operable railroad car hand brake which includes an element for preventing the chain from wrapping around the drum which moves the chain through the hand brake housing.

Another purpose is a railroad car hand brake of the type described which includes a chain stripper positioned within the hand brake housing and having a portion which is positioned between the incoming and outgoing chain and extends toward the drum.

Other purposes will appear in the ensuing specification, drawings and claims.

BRIEF DESCRIPTION OF THE DRAWINGS

The invention is illustrated diagrammatically in the following drawings wherein:

FIG. 1 is a partial front view of a railroad hand brake housing assembly including the improvement of the present invention, FIG. 2 is a bottom view of the hand brake housing assembly of FIG. 1, FIG. 3 is a side view of the hand brake housing assembly of FIGS. 1 and 2, FIG. 4 is a side view, in partial section, of the hand brake chain drum and associated drive gear, and FIG. 5 is a section along plane 5—5 of FIG. 4.

DESCRIPTION OF THE PREFERRED EMBODIMENT

The present invention relates to railroad car hand brakes of the type in which turning of the hand brake wheel causes a chain to move through the hand brake housing for applying and releasing the car brakes. In particular, the invention is concerned with what has been termed a chain stripper or chain release element which fits within the hand brake housing and adjacent the pocketed chain drum to strip the chain from the drum and thus prevent the chain from being wrapped about the drum.

Only a portion of the hand brake housing assembly is shown herein, and it will be understood by those skilled in the art that the gear which rotates within the hand brake housing will interact with a ratchet to hold the gear and thus the hand brake in any adjusted position. Further, there is a release handle which functions to release the ratchet and thereby release the gear so that the brakes can be either released or applied.

In FIG. 1, a housing is indicated generally at 10 and includes a front housing 12 and a back plate 14 which may be suitably attached to front housing 12 by rivets or the like positioned in aligned holes 16. The front housing has a large bottom opening 18, indicated in FIGS. 1 and 2, through which a drive gear 20 extends and through which chain 22 will pass as it is moved when the hand brake is operated.

A shaft 24 extends through aligned openings in cover 12 and back plate 14, through gear 20 and through a pocketed drum 26 which may be welded or otherwise suitably attached to gear 20. A hand brake wheel, not shown, will drive gear 20 through a pinion, with rotation of the gear turning chain drum 26.

Pocketed drum 26 comprises a pair of facing hub sections 28 which define between them a plurality of pockets, in this case four, each of which is indicated at 30 and illustrated particularly in FIG. 4. The pockets are separated by spokes 32, best seen in FIGS. 1 and 5. There is a slot 34 formed through each of spokes 32, with the slot joining adjacent pockets. As particularly seen in FIG. 5, each of pockets 30 have a size and shape to loosely hold one of the links 36 of chain 22.

Also positioned within housing 10 and slightly spaced from drum 26 so as to permit the passage of the chain thereabout, is a chain guard 38 which effectively separates the drum and chain portion of the hand brake assembly from the ratchet.

In function, chain 22 is wrapped about drum 26 and as gear 20 is turned, the gear and drum will rotate and the chain will move into the housing, in the direction of arrow 40 in FIG. 5, and out of the housing in the direction of arrow 42 in FIG. 5. As the chain is moved through the housing by rotation of the drum and gear, every other link 50 of the chain will be positioned within one of drum pockets 30 while the intermediate links 52 will extend through slot 34 joining adjacent pockets. Thus, the chain is releasably attached to the pocketed drum during movement of the chain through the housing. However, since the links of the chain actually fit within the pockets of the drum, at times the chain may not release from the drum pockets and tends to wrap around the drum. In order to insure that the chain is released from the drum or does not wrap around it, the present invention provides a chain stripper or chain release element.

The chain stripper is indicated generally at 54 and includes a pair of outwardly extending legs 56, each of which may be welded or otherwise suitably attached to the inside of front housing 12. Legs 56 are integral with an inwardly directed U-shaped portion 58 which extends rearwardly toward gear 20 and which mounts a generally U-shaped stripper portion 60, which portion may be welded or otherwise suitably attached to opposite sides of the U-shaped portion 58. Portion 60 extends upwardly toward the pocketed drum and as particularly shown in FIG. 3, will extend within the periphery of the drum in alignment with slot 34 Portion 60 extends within both slot 34 and pockets 30.

When the hand brake hand wheel is used to turn gear 20 and pocketed drum 26, chain 22 will be moved in and out of the housing, as indicated by arrows 40 and 42. The chain links will have alternate links positioned within drum pockets 30 and as the chain moves with the drum, in order to insure that a link positioned within a pocket is released from the pocket and does not wrap around the drum, the links will contact stripper portion 60. Note particularly in FIGS. 4 and 5 that links 52, extending through slot 34, are directly in alignment with stripper portion 60. Portion 60 of the stripper which extends into both the pockets and slot insures that the links are released from the drum.

The present invention provides a simply constructed reliable means for insuring that the individual chain links are released from the pocketed drum as the drum rotates. The stripper element extends into the area of the pocket intermediate the incoming and outgoing chain. It is impossible for the chain to wrap about the drum with the stripper element so positioned.

Whereas the preferred form of the invention has been shown and described herein, it should be realized that there may be many modifications, substitutions and alterations thereto.

The embodiments of the invention in which an exclusive property or privilege is claimed are defined as follows:

1. In a railroad car hand brake, a housing, a chain opening in said housing, a shaft mounted in said housing, a chain drum positioned within said housing and mounted on said shaft, said drum having a plurality of circumferentially spaced pockets, each formed and adapted to receive a chain link, each of said pockets being connected with adjacent pockets by a circumferentially extending slot, means engaged with and for causing rotation of said drum whereby turning of said drum moves said chain inwardly through said opening, around said drum, and outwardly through said opening, and a chain stripper having a pair of diverging legs attached to said housing and a generally U-shaped portion joining said legs and extending toward said drum, and a chain stripper portion, attached to said generally U-shaped portion, in alignment with said pockets and extending inside of the outer periphery of said drum, said chain stripper portion further extending into said slots and pockets to prevent the chain from wrapping around said drum.

* * * * *